US009259660B2

(12) United States Patent
Howard

(10) Patent No.: US 9,259,660 B2
(45) Date of Patent: Feb. 16, 2016

(54) SYSTEMS AND METHODS FOR ENHANCED BUILDING BLOCK APPLICATIONS

(71) Applicant: T. Dashon Howard, Plymouth Meeting, PA (US)

(72) Inventor: T. Dashon Howard, Plymouth Meeting, PA (US)

( * ) Notice: Subject to any disclaimer, the term of this patent is extended or adjusted under 35 U.S.C. 154(b) by 0 days.

(21) Appl. No.: 14/170,372

(22) Filed: Jan. 31, 2014

(65) Prior Publication Data

US 2015/0079872 A1 Mar. 19, 2015

Related U.S. Application Data

(63) Continuation-in-part of application No. 14/029,630, filed on Sep. 17, 2013, and a continuation-in-part of application No. 14/089,599, filed on Nov. 25, 2013, which is a continuation-in-part of application No. 14/029,630, filed on Sep. 17, 2013.

(51) Int. Cl.
*A63H 33/04* (2006.01)

(52) U.S. Cl.
CPC ..... *A63H 33/046* (2013.01); *Y10T 29/42* (2015.01)

(58) Field of Classification Search
USPC ..... 446/85, 90, 91, 108, 124, 477, 484
See application file for complete search history.

(56) References Cited

U.S. PATENT DOCUMENTS

| | | | |
|---|---|---|---|
| 1,292,188 | A | 1/1919 | Wheeler |
| 2,688,820 | A | 9/1954 | Shemet |
| 2,843,971 | A | 7/1958 | Gardellin |
| 3,359,657 | A | 12/1967 | Hedberg |
| 3,564,758 | A | 2/1971 | Willis |
| 3,654,375 | A | 4/1972 | Geiger |
| 3,655,201 | A | 4/1972 | Nichols |
| 3,662,486 | A | 5/1972 | Freedman |
| 3,666,607 | A | 5/1972 | Weissman |
| 3,728,201 | A | 4/1973 | Stroehmer |
| 3,782,029 | A | 1/1974 | Bardot |
| 3,785,066 | A | 1/1974 | Tuitt |
| 4,026,087 | A | 5/1977 | White |
| 4,064,662 | A | 12/1977 | O'toole |

(Continued)

FOREIGN PATENT DOCUMENTS

| | | | |
|---|---|---|---|
| BE | 898431 | A1 | 6/1984 |
| CA | 2214697 | A1 | 6/1998 |

(Continued)

OTHER PUBLICATIONS

"Ball of Whacks", [online]. © 1996-2013, Amazon.com, Inc. [archved on Sep. 1, 2013]. Retrieved from the Internet: <URL: https://web.archive.org/web/20130901214911/http://www.amazon.com/Creative-Whack-BOW30-Ball-Whacks/dp/0911121013>, (2013), 5 pgs.

(Continued)

*Primary Examiner* — Kurt Fernstrom
(74) *Attorney, Agent, or Firm* — Schwegman Lundberg & Woessner, P.A.

(57) ABSTRACT

Enhanced building blocks may be shaped as platonic solids. The building blocks include a flange on one or more edges, where each flange and each compressed tetrahedral vertex may include magnetic materials (e.g., magnets, ferromagnetic metals). The building block flanges may be used to capture kinetic energy from a fluid. Multiple building blocks may be combined to form larger structures, and the included magnetic materials may be used to retain the formed geometric structure shape.

13 Claims, 9 Drawing Sheets

(56) References Cited

U.S. PATENT DOCUMENTS

| | | | | |
|---|---|---|---|---|
| 4,258,479 | A | 3/1981 | Roane | |
| 4,380,133 | A | 4/1983 | Arnstein | |
| 4,492,723 | A | 1/1985 | Chadwick, II | |
| 4,864,796 | A | 9/1989 | Diamond | |
| 5,104,125 | A | 4/1992 | Wilson | |
| 5,108,100 | A | 4/1992 | Essebaggers et al. | |
| 5,205,556 | A | 4/1993 | Stallman | |
| 5,429,515 | A * | 7/1995 | Greenwood | 434/247 |
| 5,489,230 | A | 2/1996 | Gavula, Jr. | |
| 5,895,306 | A | 4/1999 | Cunningham | |
| 5,961,365 | A | 10/1999 | Lambert et al. | |
| 6,264,199 | B1 | 7/2001 | Schaedel | |
| 6,293,800 | B1 | 9/2001 | Robertson | |
| D457,833 | S | 5/2002 | Juan et al. | |
| 6,431,936 | B1 | 8/2002 | Kiribuchi | |
| 6,443,796 | B1 * | 9/2002 | Shackelford | 446/91 |
| 6,524,161 | B1 * | 2/2003 | Asami | 446/485 |
| 6,585,553 | B1 * | 7/2003 | Fetridge et al. | 446/91 |
| 6,749,480 | B1 | 6/2004 | Hunts | |
| 6,895,722 | B1 | 5/2005 | Ponder | |
| 7,018,690 | B2 | 3/2006 | Lee | |
| 7,708,615 | B2 * | 5/2010 | Munch | 446/91 |
| 8,047,889 | B2 | 11/2011 | Ishii | |
| D660,685 | S | 5/2012 | Bucci | |
| 8,398,268 | B2 | 3/2013 | Elberbaum et al. | |
| 8,507,778 | B2 | 8/2013 | Olson | |
| 8,753,164 | B2 * | 6/2014 | Hansen et al. | 446/91 |
| 8,911,275 | B2 * | 12/2014 | Maddocks et al. | 446/91 |
| 8,979,608 | B2 | 3/2015 | Hawthorne | |
| 2001/0021619 | A1 | 9/2001 | Forkman | |
| 2001/0041493 | A1 | 11/2001 | Esterle | |
| 2003/0153243 | A1 | 8/2003 | Haas | |
| 2006/0252340 | A1 * | 11/2006 | Bach et al. | 446/124 |
| 2007/0037469 | A1 | 2/2007 | Yoon | |
| 2008/0073999 | A1 * | 3/2008 | Wischnewskij et al. | 310/323.03 |
| 2009/0309302 | A1 | 12/2009 | Langin-Hooper | |
| 2011/0001394 | A1 * | 1/2011 | Dalla Piazza et al. | 310/325 |
| 2011/0043079 | A1 * | 2/2011 | Shirai et al. | 310/365 |
| 2012/0122059 | A1 * | 5/2012 | Schweikardt et al. | 434/118 |
| 2013/0165012 | A1 | 6/2013 | Klauber et al. | |
| 2013/0217294 | A1 * | 8/2013 | Karunaratne | 446/90 |
| 2014/0227934 | A1 | 8/2014 | Rudisill | |
| 2015/0079870 | A1 | 3/2015 | Howard | |
| 2015/0079871 | A1 | 3/2015 | Howard | |

FOREIGN PATENT DOCUMENTS

| | | | |
|---|---|---|---|
| CN | 201643725 | U | 11/2010 |
| DE | 19617526 | A1 | 5/1997 |
| EP | 0261753 | A2 | 3/1988 |
| FR | 2114528 | A5 | 6/1972 |
| GB | 1603060 | A | 11/1981 |
| GB | 2302344 | A | 1/1997 |
| KR | 200454067 | Y1 | 6/2011 |
| WO | WO-9535142 | A1 | 12/1995 |
| WO | WO-2006040852 | A1 | 4/2006 |
| WO | WO-2008043535 | A1 | 4/2008 |
| WO | WO-2015042172 | A1 | 3/2015 |
| WO | WO-2015077760 | A1 | 5/2015 |
| WO | WO-2015116928 | A1 | 8/2015 |

OTHER PUBLICATIONS

"Magna-Tiles Clear Colors 32 piece set", [online]. © 1996-2013, Amazon.com, Inc. [archived on Sep. 8, 2013]. Retrieved from the Internet: <http://www.amazon.com/Magna-Tiles-Clear-Colors-piece-set/dp/B000CBSNKQ/>, (2013), 5 pgs.

"Toy / Game Popular Playthings Mag-Blocks", [online]. © 1996-2014, Amazon.com, Inc. [retrieved on Apr. 28, 2014]. Retrieved from the Internet: <URL: http://www.amazon.com/Game-Popular-Playthings-Mag-Blocks-Easy-To-Handle/dp/B00CGG75JA/>, (2014), 3 pgs.

"U.S. Appl. No. 14/029,630, Non Final Office Action mailed Feb. 23, 2015", 7 pgs.

"U.S. Appl. No. 14/029,630, Non Final Office Action mailed Oct. 7, 2014", 5 pgs.

"U.S. Appl. No. 14/029,630, Response filed Jan. 7, 2015 to Non Final Office Action mailed Oct. 7, 2014", 6 pgs.

"U.S. Appl. No. 14/029,630, Response filed Feb. 27, 2015 to Non Final Office Action mailed Feb. 23, 2015", 9 pgs.

"U.S. Appl. No. 14/089,599, Non Final Office Action mailed Feb. 23, 2015", 9 pgs.

"U.S. Appl. No. 14/089,599, Notice of Allowance mailed Apr. 2, 2015", 6 pgs.

"U.S. Appl. No. 14/089,599, Response filed Mar. 13, 2015 to Non Final Office Action mailed Feb. 23, 2015", 7 pgs.

"U.S. Appl. No. 14/089,599, Response filed Dec. 22, 2014 to Restriction Requirement mailed Oct. 22, 2014", 6 pgs.

"U.S. Appl. No. 14/089,599, Restriction Requirement mailed Oct. 22, 2014", 6 pgs.

"International Application Serial No. PCT/US2014/056130, International Search Report mailed Nov. 27, 2014", 5 pgs.

"International Application Serial No. PCT/US2014/056130, Written Opinion mailed Nov. 27, 2014", 5 pgs.

"International Application Serial No. PCT/US2014/067330, International Search Report mailed Feb. 17, 2015", 4 pgs.

"International Application Serial No. PCT/US2014/067330, Written Opinion mailed Feb. 17, 2015", 7 pgs.

"U.S. Appl. No. 14/029,630, Notice of Allowance mailed May 8, 2015", 5 pgs.

"U.S. Appl. No. 14/029,630, Notice of Allowance mailed Jul. 8, 2015", 5 pgs.

"U.S. Appl. No. 14/245,249, Non Final Office Action mailed Jun. 30, 2015", 7 pgs.

"International Application Serial No. PCT/US2015/013766, International Search Report mailed May 11, 2015", 4 pgs.

"International Application Serial No. PCT/US2015/013766, Written Opinion mailed May 11, 2015", 5 pgs.

"International Application Serial No. PCT/US2015/023973, International Search Report mailed Jun. 18, 2015", 4 pgs.

"International Application Serial No. PCT/US2015/023973, Written Opinion mailed Jun. 18, 2015", 5 pgs.

* cited by examiner

SYSTEMS AND METHODS FOR ENHANCED BUILDING BLOCK APPLICATIONS

CROSS-REFERENCE TO RELATED APPLICATIONS

The present application is a Continuation-in-Part of U.S. application Ser. No. 14/029,630, filed Sep. 17, 2013, which is incorporated herein by reference in its entirety.

The present application is a Continuation-in-Part of U.S. application Ser. No. 14/089,599, filed Nov. 25, 2013, which is a Continuation-in-Part of U.S. application Ser. No. 14/029, 630, both of which are incorporated herein by reference in their entirety.

FIELD

The present invention relates to building blocks, and specifically to magnetic educational toy blocks.

BACKGROUND

Building blocks may be assembled in various configurations to form different geometric structures. Groups of building blocks may be used as an educational toy by children, or may be used by adults or children to explore various two-dimensional or three-dimensional shapes.

DETAILED DESCRIPTION

Enhanced building blocks may be formed from one or more basic shapes. Enhanced building blocks may include magnetic materials (e.g., magnets, ferromagnetic metals), piezoelectric materials, or lights (e.g., LEDs). Enhanced building blocks may be combined to form or give the appearance of various geometric structures, and the included magnetic materials may be used to retain the formed geometric structure shape. An enhanced building block may be formed from a tetrahedral building block, and may be referred to as an "un-shape" building block.

In the following description, reference is made to the accompanying drawings that form a part hereof, and in which is shown by way of illustration specific embodiments that may be practiced. These embodiments are described in sufficient detail to enable those skilled in the art to practice the invention, and it is to be understood that other embodiments may be utilized and that structural, logical, and electrical changes may be made without departing from the scope of the present invention. The following description of example embodiments is, therefore, not to be taken in a limited sense, and the scope of the present invention is defined by the appended claims.

Figure 1:
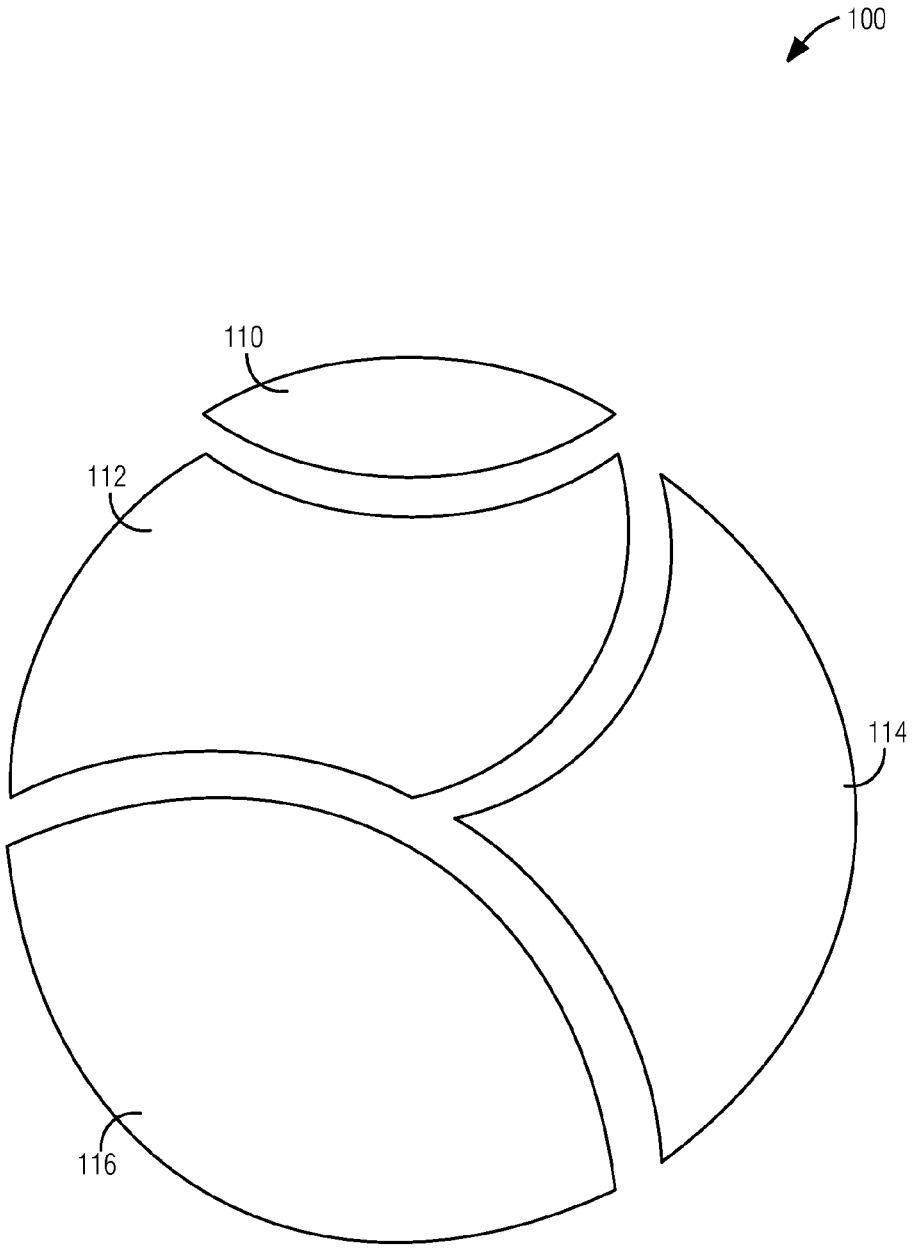
FIG. 1 is a front view of a first set of shapes that may be used to form an enhanced building block.

FIG. 1 is a front view of a first set of shapes 100 that may be used to form an enhanced building block, according to an embodiment. In an embodiment, a circular shape is separated using a plurality of arcs to form one or more shapes 110, 112, 114, and 116. Two or more of these shapes 110, 112, 114, and 116 may be combined to form an enhanced device, such as is shown in FIG. 2.

Figure 2A:
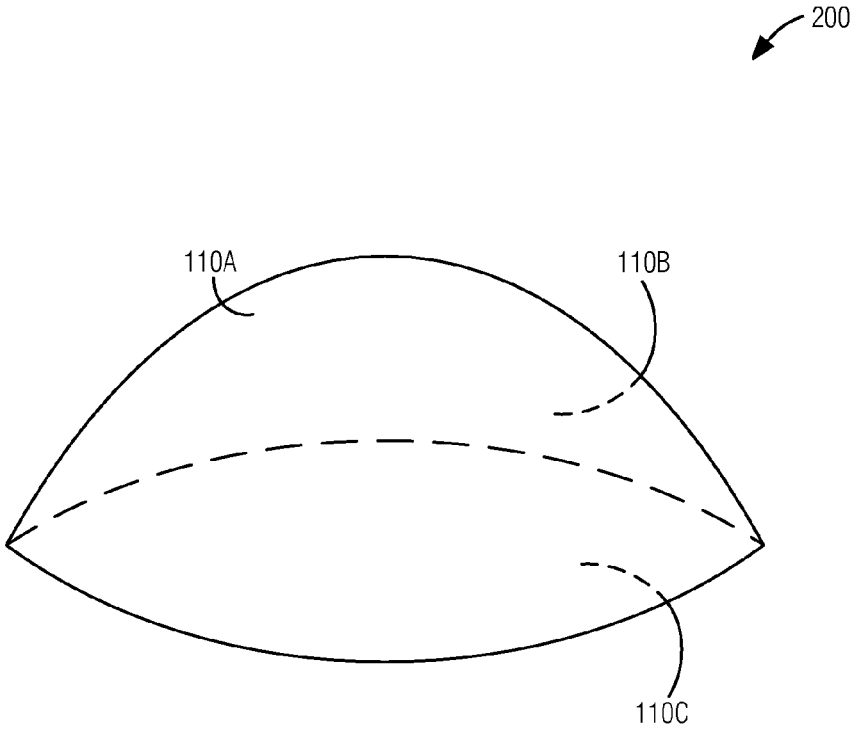
FIGS. 2A-2B are perspective views of a first example enhanced building block.
Figure 2B:
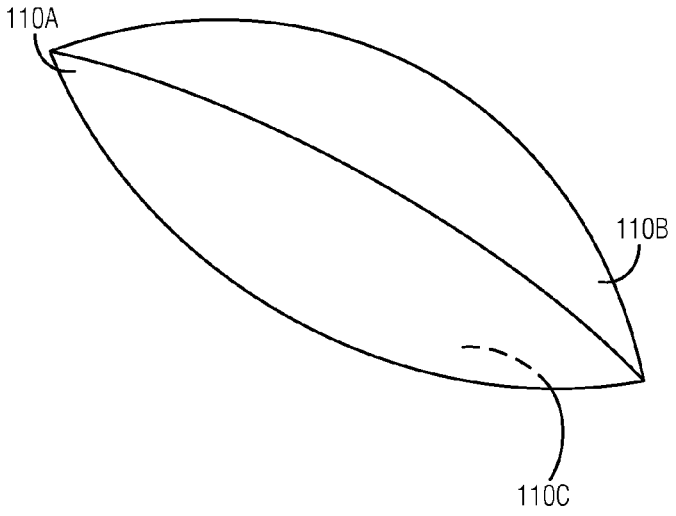
Figure 3A:
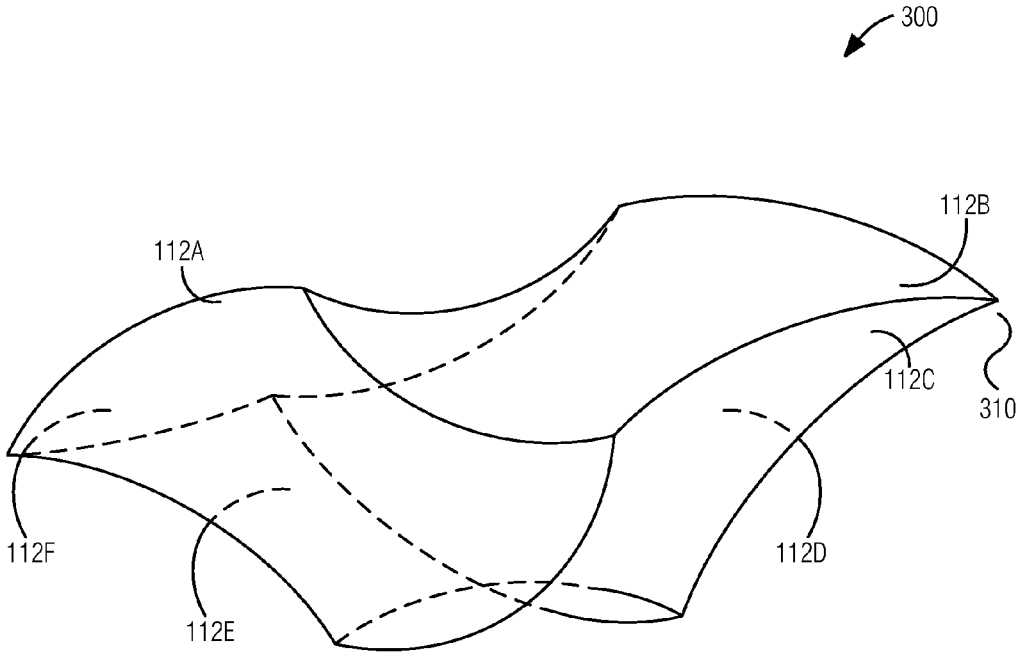
FIGS. 3A-3B are perspective views of a second example enhanced building block.
Figure 3B:
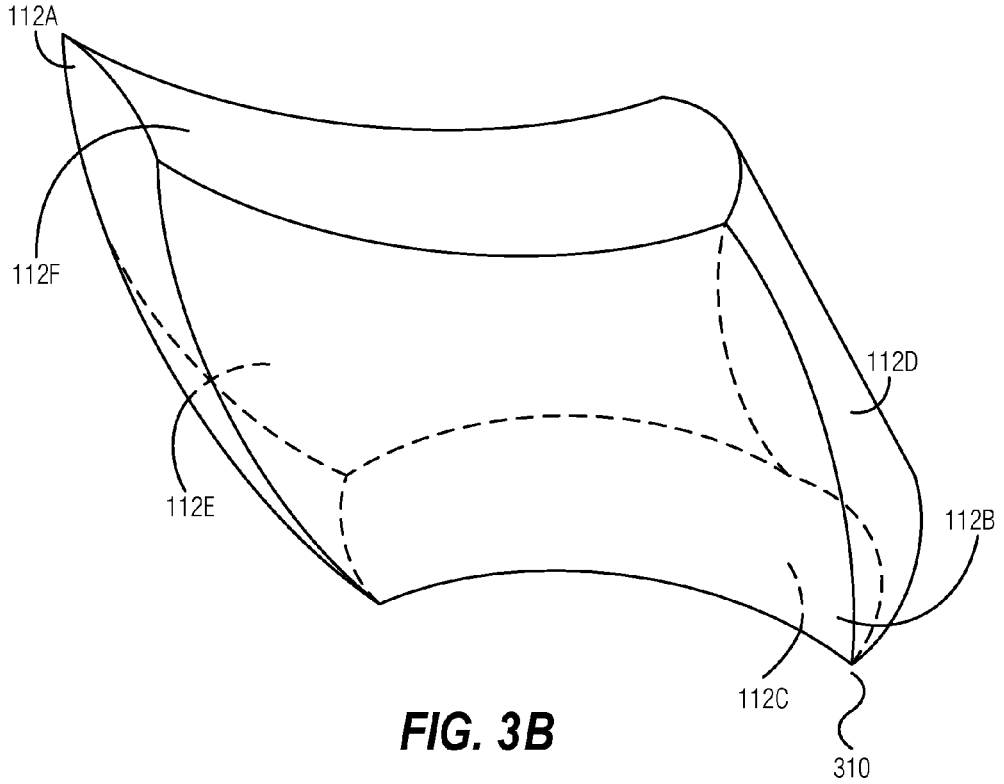

FIGS. 2A-2B are perspective views of a first example enhanced building block 200, according to an embodiment. Using three of the elliptical shapes 110 shown in FIG. 1, a basic enhanced building block 200 may be formed using a first side 110A, a second side 110B, and a third side 110C. The side perspective view shown in FIG. 2A presents the first side 110A to the viewer, where second side 110B and third side 110C are behind first side 110A. The top perspective view shown in FIG. 2B shows the first side 110A and second side 110B, occluding the third side 110C. Additional shapes may be used, and additional sides may be combined to form other shapes. In an embodiment, a fourth elliptical shape may be used to form a four-sided enhanced that resembles a football. In another embodiment, FIGS. 3A-3B are perspective views of a second example enhanced building block 300, according to an embodiment. Using the four-sided shapes 112 shown in FIG. 1, a basic enhanced building block 300 may be formed from six sides 112A-112F. The six sides 112A-112F may be arranged analogous to the six sides of a cube, though each four-sided shape 112 may be curved to allow its edges to meet the edges of each adjacent side. The side perspective view shown in FIG. 3A presents the first, second, and third sides 112A-112C to the viewer, where fourth, fifth, and sixth sides 112D-112F are occluded by the enhanced building block 300. Sides 112B-112D may meet at vertex 310, and vertex 310 may be rotated toward the viewer to yield the top perspective view shown in FIG. 3B. The top perspective view shown in FIG. 3B presents sides 112A, 112B, 113D, and 112F to the viewer, where sides 112C and 112E are occluded by the enhanced building block 300. Additional shapes may be used, and additional sides may be combined to form other shapes.

Multiple enhanced building blocks may be combined using a template (e.g., visual guide). The template may serve as an outline for various arrangements of enhanced devices. The template may include a continuous background of a particular color, or the template may include one or more lines to suggest a preferred arrangement of enhanced devices, such as is shown in FIG. 1. The template may be two-dimensional or three-dimensional. For example, the template could be shaped as a flat circle or square, or the template could be shaped as a hemisphere or open cube. The template may be designed to accommodate one or more two-dimensional or three-dimensional enhanced devices. For example, multiple curved enhanced devices may be arranged to fill a hemispherical template.

In various embodiments, the enhanced building blocks may be transparent, may be translucent, may include a semi-transparent material comprised of a color, or may include a solid (e.g., opaque) material. One or more light emitting diodes (LEDs) may be embedded within an enhanced surface. For example, LEDs may be connected to electrically conductive grid lines within the enhanced surfaces, and may receive power through the grid lines. Power may be provided to the LEDs through a power storage element (e.g., capacitor, battery) or through a power generating element (e.g., solar cell, piezoelectric component). The electrically conductive grid lines may conduct power to the LEDs for educational purposes. For example, two enhanced devices may detect proximity using a magnetic or other proximity detection mechanism, and the proximity detection may convey power to the LEDs to indicate that the enhanced devices have been placed in the correct arrangement. The electrically conductive grid lines may serve as contour lines for educational purposes. For example, a two-dimensional surface with a grid pattern may be used to form one or more curved enhanced surfaces, and the curved enhanced surfaces will exhibit a visual distortion of the grid pattern according to the curvature of each surface. In another example, one or more enhanced surfaces may be formed using organic light emitting diodes (OLEDs) or liquid crystal displays (LCDs), and may display various human-readable or machine-readable information.

The enhanced building block may alter its appearance based on the presence of electrical current, an electric or magnetic field, sound vibration, or other external force. The enhanced building block may include one or more piezoelectric component, and this piezoelectric component may convert between mechanical and electrical inputs. For example, a quartz piezoelectric element may be included at each of the two vertices in the enhanced building block 210, and may be used to generate power for one or more LEDs. The piezoelectric element may be used for educational purposes. For example, two enhanced devices may detect proximity using a magnetic or other proximity detection mechanism, and the proximity detection may convey power to the piezoelectric element to generate a sound to indicate that the enhanced devices have been placed in the correct arrangement. One or more mechanical or electromechanical resonant devices may be used to modify, propagate, amplify, or mitigate externally applied vibration. For example, a mechanical tuning fork may be used to amplify vibration induced in a piezoelectric element.

In some embodiments, using electrochemical materials, application of an electrical current may transition one or more surfaces of the enhanced building block to translucent, clouded, or colored. A solid enhanced building block may be used to conduct vibration, such as in acoustic or other applications. For example, induced mechanical vibration may be used in vibration therapy. The enhanced building block may be constructed using a conductive material for various electrical applications. For example, one or more of the faces of the enhanced building block may be comprised of silicon, where the silicon is arranged to function as a resistor, inductor, capacitor, transistor, complete microchip (e.g., integrated circuit), or other electrical component. Multiple enhanced building blocks may be arranged to propagate conducted vibration. For example, a mechanical vibration may be generated by applying an electric current to a piezoelectric element in a first building block, and this vibration may be conducted by the second building block and converted to an electrical impulse.

The enhanced building block may be made of a transparent material, and may be of a uniform or nonuniform thickness. The enhanced building block may include one or more photovoltaic cells, and may be used in solar power applications. For example, the cross-section of the enhanced building block may be convex or concave, and may be used as a lens in various optical applications. The enhanced building block may include various color patterns. Various additional ornamental designs may be used on each side of the enhanced building block. Various designs may include lines comprised of magnetic tape, where information may be encoded or transferred using the magnetic tape. For example, standard magnetic tape encoders and readers may be used to record or read information encoded on a magnetic tape stripe on an exterior surface. Various designs may include lines comprised of electrically conductive materials, such as copper. The enhanced building block may be constructed using a flexible material to allow the three faces to expand or contract.

The lines within each enhanced device may be uniformly distributed. For example, a circular enhanced template may include a series of arcs radiating from the circle center to the circle radius, where each arc is spaced apart from adjacent arcs by forty-five degrees. Enhanced devices corresponding to this circular two-dimensional enhanced template may have corresponding arc portions, and the arc portions may aid the user in arranging the enhanced devices on the template. In other embodiments, the grid lines may be irregular in shape or spacing, may be configured in a fractal pattern, or may be configured in another arrangement.

The inner space may include one or more gasses, such as noble gasses or gasses that are translucent or colored. The inner space may include one or more fluids (e.g., gasses or liquids). The fluid may be selected according to its response to heating or cooling. In another example, a fluid with a high heat capacity may store energy received from solar heating, such as in concentrated solar power applications. The fluid may be selected according to its ability to change color or light absorption. For example, a suspended particle fluid may transition from a clouded appearance to a translucent appearance in the presence of an electrical voltage. Various levels of transparency or various shades of color may be used. The use of semi-transparent materials of various colors may allow the colors to be combined depending on orientation. For example, if the device is held so a blue face is superimposed on a yellow face, the object may appear green. Similarly, multiple enhanced building blocks may be combined to yield various colors. Multiple enhanced building blocks may be combined to form the appearance of various platonic solids, where the platonic solid appearance may depend on each enhanced building block's specific periodicities of motion and wave positions in time as indicated by the direction of particular intersecting linear projections. For example, the vertices of multiple enhanced building blocks may be combined to form a larger enhanced device.

Figure 4:
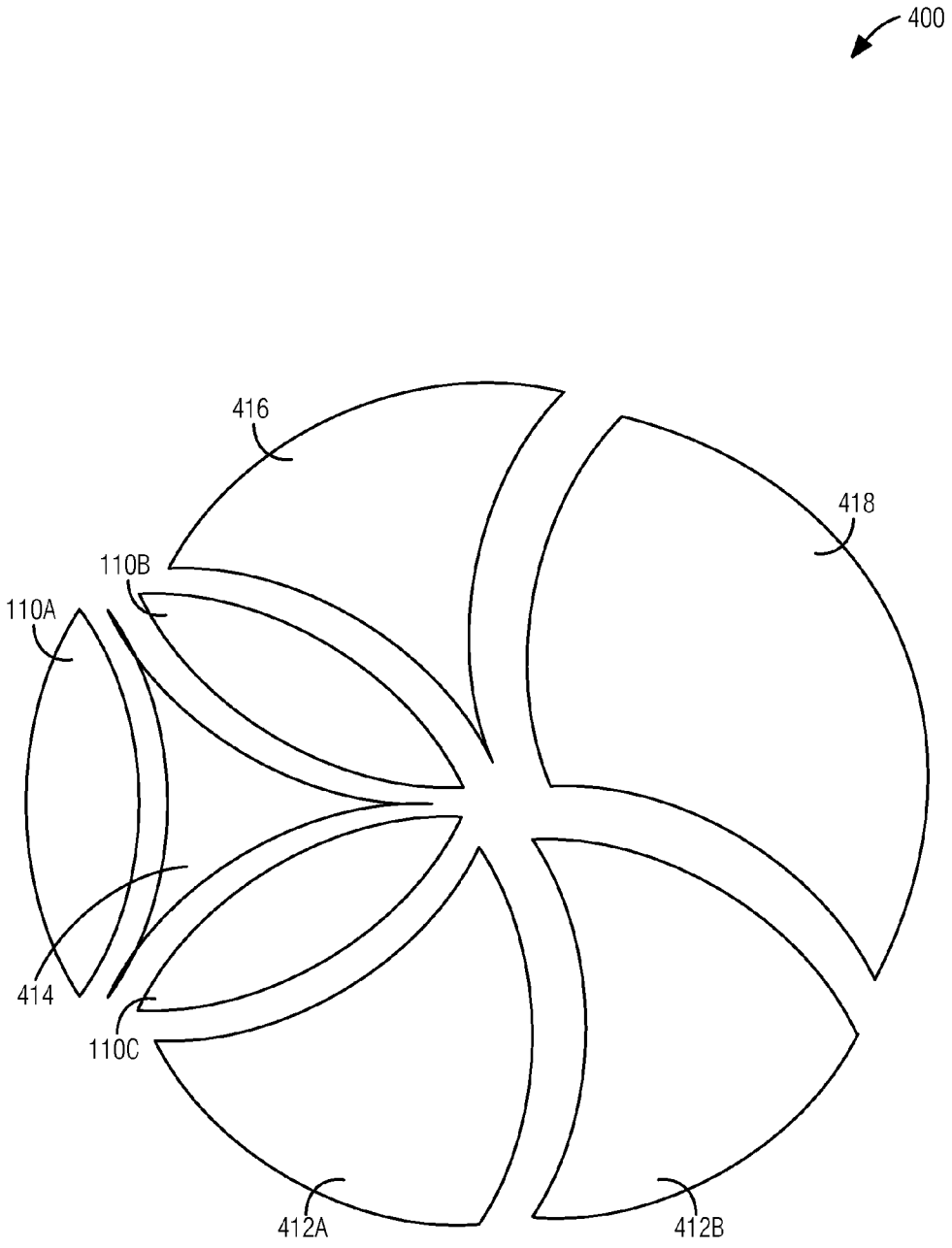
FIG. 4 is a front view of a second set of shapes that may be used to form an enhanced building block.

FIG. 4 is a front view of a second set of shapes 400 that may be used to form an enhanced building block, according to an embodiment. In an embodiment, a circular shape is separated using a plurality of arcs to form one or more shapes. Two or more of these shapes may be mutually congruent, such as 110A-110C or 412A and 412B. Other shapes may be distinct, including 414, 416, or 418. In addition to forming one or more three-dimensional enhanced devices using a combination of these two-dimensional shapes, these shapes may be formed from a tetrahedral device, such as is shown in FIG. 5.

Figure 5:
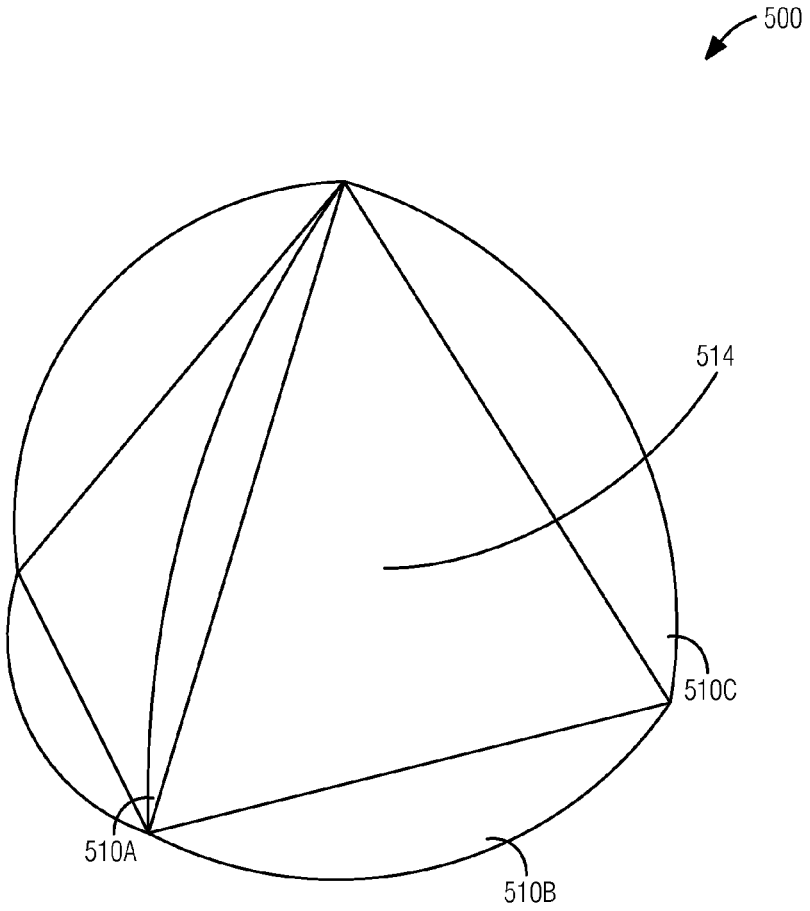
FIG. 5 is a perspective view of a tetrahedral building block used to form one or more enhanced building blocks.

FIG. 5 is a perspective view of a tetrahedral building block 500 used to form one or more enhanced building blocks. As fully described in the Related Applications referenced above, the tetrahedral device may include a tetrahedral inner volume with triangular surfaces 514 and elliptical flanges 510A-510C. The triangular surfaces 514 may be formed using scalene, isosceles, or equilateral triangles, where each equilateral triangle interior angle is one hundred and twenty degrees. Various devices may be created by adding or removing various shapes or by expanding or contracting the inner tetrahedral volume, such as is shown in FIG. 6.

Figure 6:
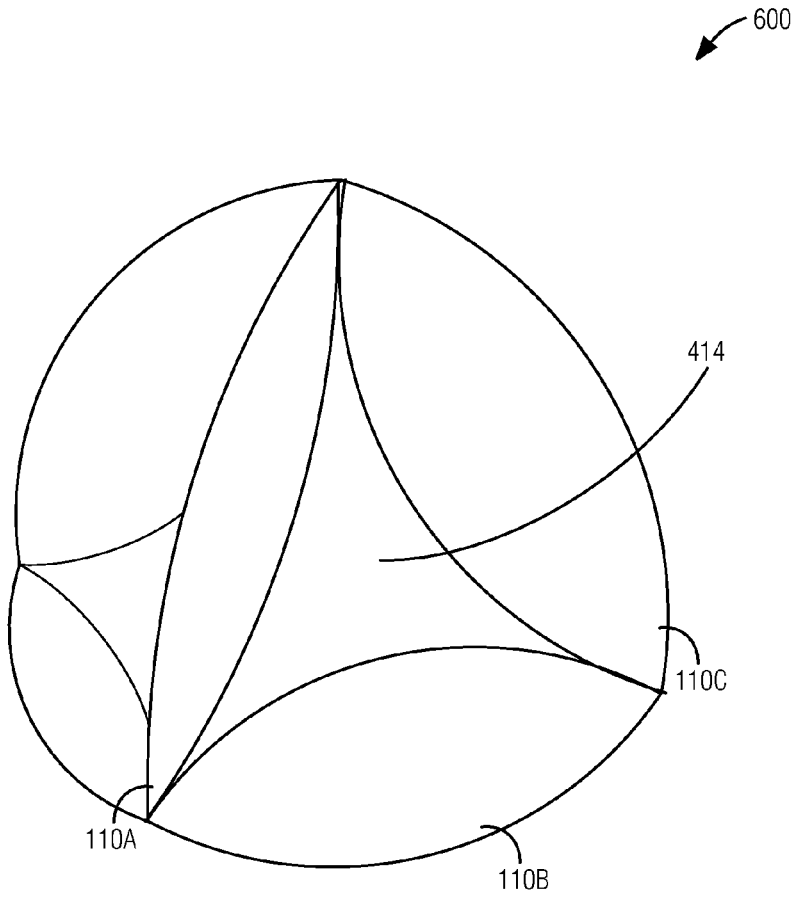
FIG. 6 is a perspective view of a third example enhanced building block formed from a tetrahedral building block.

FIG. 6 is a perspective view of a third example enhanced building block 600 formed from a tetrahedral building block, according to an embodiment. An enhanced device may be formed by contracting the inner volume of a tetrahedral device. For example, by contracting the tetrahedral inner volume of a tetrahedral device, various surfaces shown in FIG. 4 may be created, such as 110A-110C and 414. The three contracted triangular faces 414 may define an inner volume, whereas shapes 110A-110C may form elliptical flanges. Each flange may be constructed using a semi-flexible or inflexible material and connected at each triangle contracted triangular face using a hinge, where the hinge may be constructed using a flexible material or a mechanical hinge. The flanges may be collapsed (e.g., closed) toward the inner volume of the enhanced building block, and may become flush (e.g., coplanar) with the respective contracted triangular surfaces. A fluid within the inner volume may expand or contract and cause one or more flanges to open or close.

The flanges may be collapsed or opened fully or partially through various methods. The flanges may be collapsed or opened by various active mechanical or electromechanical devices. These devices may include hydraulic actuators, servos, or other mechanical or electromechanical means. For example, the flanges or inner tetrahedral surfaces may contain magnetic or electromagnetic material, and one or more electromagnets may be energized selectively to collapse or open one or more flanges. An electromagnetic field may be used to cause movement of one or more flanges, or may be used to arrange two or more enhanced devices in a predetermined configuration. In embodiments where the flanges define an inner volume, the flanges may be collapsed or opened by heating or cooling a fluid (e.g., increasing or decreasing molecular vibration) contained within the enhanced. For example, the fluid may be heated using solar energy, and the expanding fluid may fill the flanges and cause them to open. The flanges may be collapsed or opened by various passive methods, such as collapsing and opening opposing flanges alternatingly in response to a fluid. For example, a moving fluid such as wind may open a flange and cause the enhanced device to rotate around its axis of symmetry, and as the flange rotates into the wind, the wind may collapse that flange.

In some embodiments, the contracted triangular surfaces may also be collapsed or removed to allow nesting (e.g., stacking) of two or more enhanced building blocks. Two or more enhanced building blocks may be nested, and may be connected at one or more connection points via mechanical, magnetic, or by other means. For example, a magnetic flange may adhere to magnetic inner volume. Multiple enhanced devices may be nested on one or more of the vertices of the contracted triangular faces. For example, multiple devices may be nested on the three bottom vertices to form a tripod configuration, and multiple devices may be nested on the top vertex to form a vertical column. In an additional example, a second nested tripod configuration could be arranged on the vertical column, where each of the three tripod legs serves as a counterbalance for the other two tripod legs. Enhanced devices may be designed asymmetrically so that a series of enhanced building blocks may be connected to form a circle, polygon, or other shape. Any combination of nested enhanced devices may be used to form larger structures. Nested enhanced structures may be expanded or reinforced by adding additional shapes, such as those shown in FIG. 1, 4, or 7.

Figure 7:
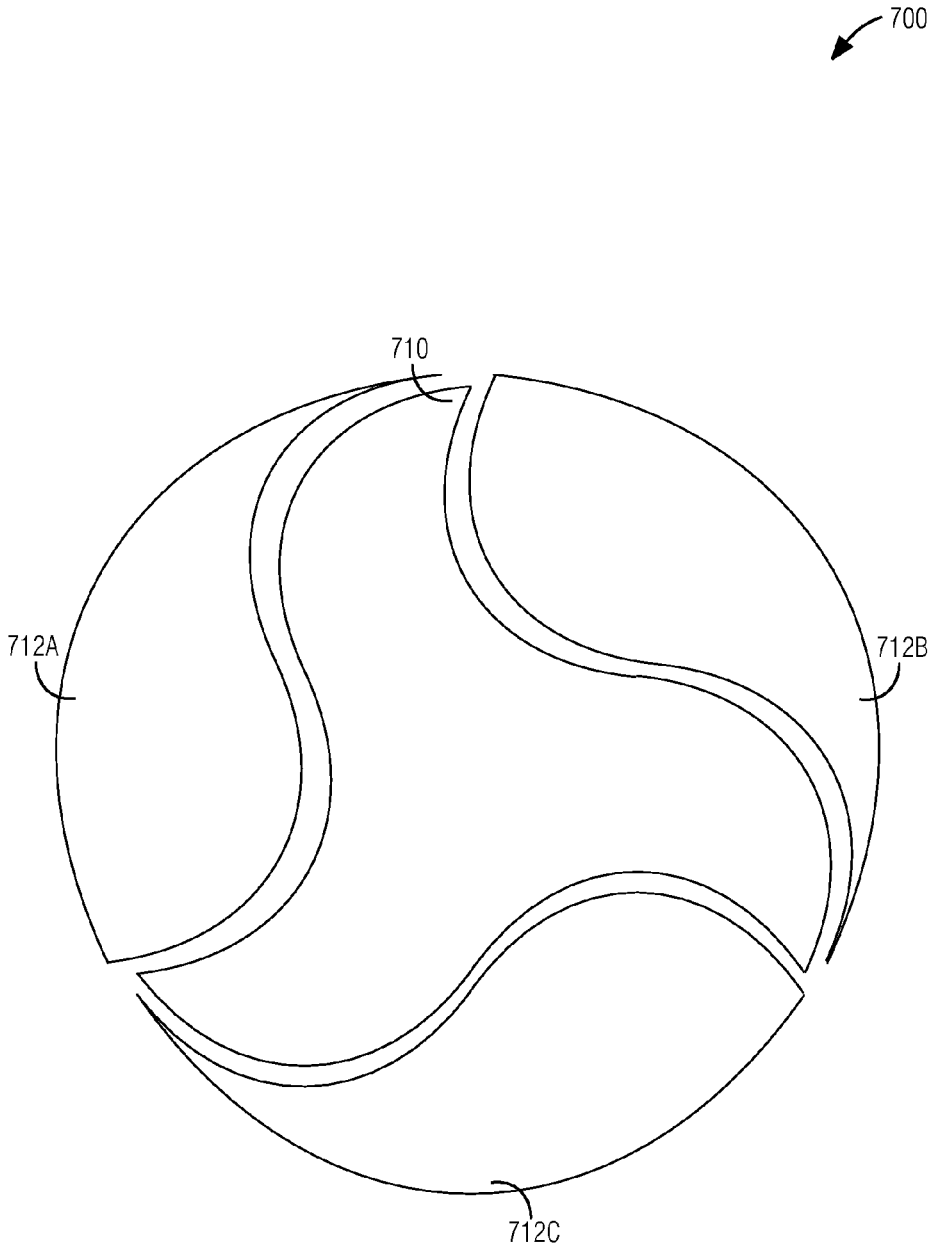
FIG. 7 is a front view of a third set of shapes that may be used to form an enhanced building block.

FIG. 7 is a front view of a third set of shapes 700 that may be used to form an enhanced building block, according to an embodiment. A fan shape 710 may be formed by removing three curved shapes 712A-712C. In an embodiment, three curved shapes 712A-712C may be combined to form a three-dimensional enhanced building block.

Figure 8:
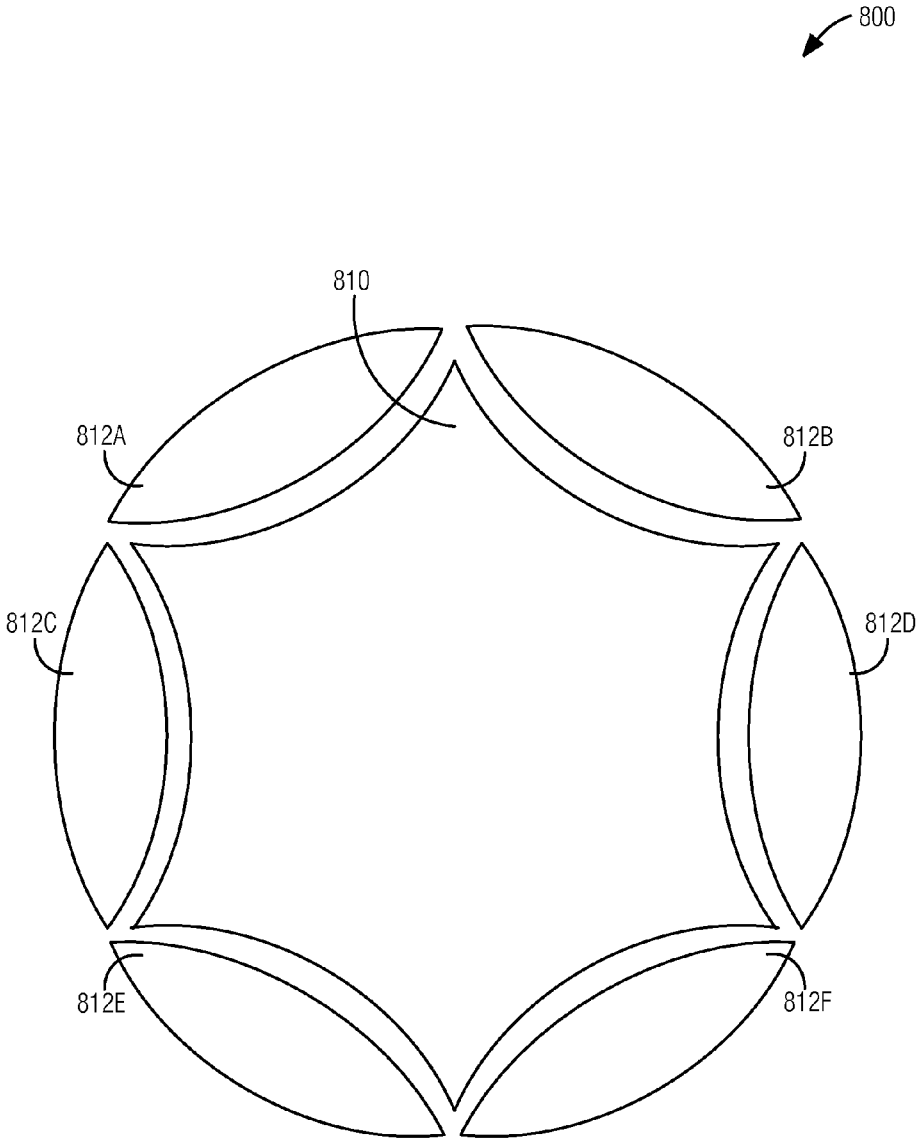
FIG. 8 is a front view of a fourth set of shapes that may be used to form an enhanced building block.

FIG. 8 is a front view of a fourth set of shapes 800 that may be used to form an enhanced building block, according to an embodiment. In an embodiment, a circular shape is separated using a plurality of arcs to form seven shapes, including a central six-pointed shape 810. The arcs may form two or more mutually congruent shapes, such as 812A-812F. One or more of these two-dimensional shapes may be combined with other two-dimensional shapes to form one or more three-dimensional enhanced devices, such as is shown in FIG. 9.

Figure 9:
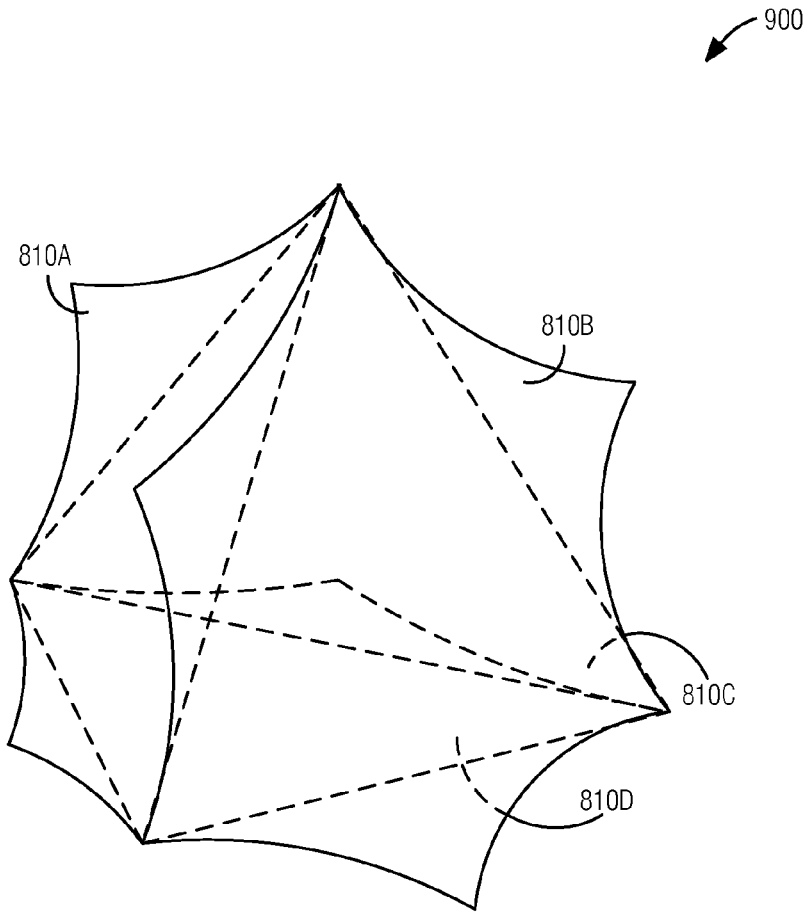
FIG. 9 perspective view of a fourth example enhanced building block.

FIG. 9 perspective view of a fourth example enhanced building block 900, according to an embodiment. Using four of the six-pointed shapes 810, a basic enhanced building block 900 may be formed using a first side 810A, a second side 810B, a third side 810C, and a fourth side 810D. The perspective view shown in FIG. 9 presents the first and second sides 810A and 810B to the viewer, where the third side 810C is behind the first and second sides 810A and 810B, and where the fourth side 810D is on the bottom of the enhanced building block 900. As shown by the straight dotted lines in FIG. 9, the inner space in this fourth example enhanced building block 900 resembles the tetrahedral inner volume of a tetrahedral device. Though FIG. 9 shows each side of the enhanced building block 900 using a six-pointed shape 810 with curved edges, a six-pointed shape with six straight edges may be used, such as a regular (e.g., equiangular and equilateral) hexagon. Additional embodiments using regular polygons may have a number of sides that are integer multiples of three, including the hexagon with sixty degree interior angles, a twelve-sided dodecahedron with thirty degree interior angles, a twenty-four sided icosikaitetragon with fifteen degree interior angles, et cetera. Different three-dimensional enhanced building blocks may be formed using any three or more two-dimensional shapes, including any combination of arbitrary shapes or regular or irregular close-chain polygons.

In some embodiments, multiple enhanced building blocks may be connected to form a closed chain polygon (e.g., triangle, square, pentagon, etc.). The building blocks may be connected to each other by magnetic means, by soldering, or by other means. Alternatively, the enhanced building blocks may be connected to a center hub using one or more spokes per enhanced building block. The connected building blocks may be configured to rotate around the center hub, such as in response to a fluid flow (e.g., gas or liquid). For example, the connected building blocks may be used in a turbine configuration, where each enhanced building block is configured to spill and catch air depending on the angles of the flanges and orientations of the enhanced devices to cause the connected enhanced building blocks to rotate. As another example, the connected building blocks may be used in a water wheel configuration, where water may contact outer flanges and cause the connected building blocks to rotate. The building blocks may be adjusted to change the angular velocity, rotational direction, or other response of the connected building blocks to movement of a fluid across the surface of the enhanced devices. Adjustments may include collapsing or opening individual flanges, or extending or retracting the respective building blocks relative to the hub. In embodiments where the building blocks are formed from or include a framework comprised of a conductive material, the connected building blocks may be arranged to form an antenna, such as for terrestrial or satellite communication. The connected building blocks may be used to conduct vibration, such as in acoustic applications, vibration therapy, or other applications. Other hydrodynamic or aerodynamic applications may be used. In addition to these macroscopic applications for a single or multiple enhanced building blocks, enhanced building blocks may be used in various microscopic applications such as nanotechnology. For example, multiple microscopic enhanced building blocks may be configured to arrange themselves in a predefined structure in the presence of a magnetic field. Similarly, multiple microscopic enhanced building blocks may be permanently arranged in a microscopic structure with predetermined properties, such as a resistor, inductor, capacitor, transistor, complete microchip, or other electrical component.

EXAMPLES

Example 1 includes a building block comprising a first substrate, a piezoelectric element disposed on the first substrate that generates an electric charge in response to vibration, and a light emitting diode disposed on the first substrate and electrically connected to the piezoelectric element, wherein the light emitting diode is configured to provide electroluminescence in response to the electric charge generated by piezoelectric element.

Example 2 includes the subject matter of Example 1, and can optionally include a second substrate connected to the first substrate and a third substrate connected to the first substrate and to the second substrate to form a three-dimensional building block.

Example 3 includes the subject matter of Example 2, wherein at least one of the first substrate, second substrate, and third substrate is substantially planar.

Example 4 includes the subject matter of Example 1, and can optionally include a first acoustic resonator disposed on the first substrate to induce a vibration in the piezoelectric element.

Example 5 includes the subject matter of Example 1, wherein the first acoustic resonator is tuned to resonate at a selected frequency.

Example 6 includes the subject matter of Example 1, wherein the first acoustic resonator is configured to resonate sympathetically with a second acoustic resonator, and wherein the second acoustic resonator is external to the Building block.

Example 7 includes the subject matter of Example 1, wherein the first acoustic resonator is a tuning fork.

Example 8 includes the subject matter of Example 1, wherein the light emitting diode is a substantially planar organic light emitting diode.

Example 9 includes the subject matter of Example 1, and can optionally include a plurality of conductive lines disposed on the first substrate, second substrate, and third substrate.

Example 10 includes a method of making a building block, the method comprising mounting a piezoelectric element to a first substrate, wherein the first piezoelectric element generates an electric charge in response to vibration, and mounting a light emitting diode to the first substrate, the light emitting diode electrically connected to the piezoelectric element, wherein the light emitting diode is configured to provide electroluminescence in response to the electric charge generated by piezoelectric element.

Example 11 includes the subject matter of Example 10, and can optionally include mounting a second substrate to the first substrate, and mounting a third substrate to the first substrate and to the second substrate to form a three-dimensional building block.

Example 12 includes the subject matter of Example 11, and can optionally include mounting a fourth substrate to the first substrate, to the second substrate, and to the third substrate to form a three-dimensional building block.

Example 13 includes the subject matter of Example 10, and can optionally include mounting a first acoustic resonator to the first substrate to induce a vibration in the piezoelectric element.

Example 14 includes the subject matter of Example 10, wherein the first acoustic resonator is tuned to resonate at a selected frequency, wherein the first acoustic resonator is configured to resonate sympathetically with a second acoustic resonator, and wherein the second acoustic resonator is external to the building block.

Example 15 includes a method of providing feedback for building block arrangement, the method comprising detecting, using a passive component, an arrangement of a first building block with respect to a second building block, and providing a feedback signal to a user to indicate when the first building block has been arranged in a selected position with respect to the second building block.

Example 16 includes the subject matter of Example 15, wherein the passive component includes a magnetic component.

Example 17 includes the subject matter of Example 15, wherein the passive component includes a first piezoelectric component that generates an electric charge in response to vibration.

Example 18 includes the subject matter of Example 17, wherein the passive component includes a first acoustic resonator configured to resonate sympathetically with a second acoustic resonator and induce a vibration in the first piezoelectric element.

Example 19 includes the subject matter of Example 15, wherein the feedback signal includes illumining a light emitting diode.

Example 20 includes the subject matter of Example 15, wherein the feedback signal includes generating a sound using a second piezoelectric component.

This invention is intended to cover all changes and modifications of the example embodiments described herein that do not constitute departures from the scope of the claims.

What is claimed is:

1. A building block comprising:

a first substrate;

a piezoelectric element disposed on the first substrate that generates an electric charge in response to vibration;

a first acoustic resonator disposed on the first substrate to induce a vibration in the piezoelectric element, the first acoustic resonator configured to resonate sympathetically with a second acoustic resonator, the second acoustic resonator external to the building block; and a light emitting diode disposed on the first substrate and electrically connected to the piezoelectric element, wherein the light emitting diode is configured to provide electroluminescence in response to the electric charge generated by piezoelectric element.

2. The building block of claim 1, further including:

a second substrate connected to the first substrate; and a third substrate connected to the first substrate and to the second substrate to form a three-dimensional building block.

3. The building block of claim 2, further including a plurality of conductive lines disposed on the first substrate, second substrate, and third substrate.

4. The building block of claim 2, wherein:

the first acoustic resonator is further configured to resonate and induce a vibration in the piezoelectric element when first acoustic resonator is in proximity to the second acoustic resonator, the second acoustic resonator disposed in a second building block; and the piezoelectric element and light emitting diode are configured to provide electroluminescence when the building block is in proximity to the second building block.

5. The building block of claim 2, wherein:

the first acoustic resonator is further configured to resonate and induce a vibration in the piezoelectric element when first acoustic resonator is in proximity to the second acoustic resonator, the second acoustic resonator disposed in a second building block; and the piezoelectric element and light emitting diode are configured to provide electroluminescence when the building block is in proximity to the second building block.

6. The building block of claim 2, wherein at least one of the first substrate, second substrate, and third substrate is substantially planar.

7. The building block of claim 1, wherein the first acoustic resonator is tuned to resonate at a selected frequency.

8. The building block of claim 1, wherein the first acoustic resonator is a tuning fork.

9. The building block of claim 1, wherein the light emitting diode is a substantially planar organic light emitting diode.

10. A method of making a building block, the method comprising:

mounting a piezoelectric element to a first substrate, wherein the first piezoelectric element generates an electric charge in response to vibration;

mounting a first acoustic resonator to the first substrate, the first acoustic resonator configured to resonate sympathetically with a second acoustic resonator external to the building block and to induce a vibration in the piezoelectric element; and mounting a light emitting diode to the first substrate, the light emitting diode electrically connected to the piezoelectric element, wherein the light emitting diode is configured to provide electroluminescence in response to the electric charge generated by piezoelectric element.

11. The method of making a building block of claim 10, further including:

mounting a second substrate to the first substrate; and mounting a third substrate to the first substrate and to the second substrate to form a three-dimensional building block.

12. The method of making a building block of claim 11, further including mounting a fourth substrate to the first substrate, to the second substrate, and to the third substrate to form a three-dimensional building block.

13. The method of making a building block of claim 10, wherein the first acoustic resonator is tuned to resonate at a selected frequency.

* * * * *